US011516591B2

(12) United States Patent
Xu et al.

(10) Patent No.: US 11,516,591 B2
(45) Date of Patent: Nov. 29, 2022

(54) SPEAKER AND SPEAKER MODULE

(71) Applicant: Goertek Inc., Shandong (CN)

(72) Inventors: Zengqiang Xu, Shandong (CN); Yong Chu, Shandong (CN)

(73) Assignee: Goertek Inc., Weifang (CN)

( * ) Notice: Subject to any disclaimer, the term of this patent is extended or adjusted under 35 U.S.C. 154(b) by 71 days.

(21) Appl. No.: 17/256,716

(22) PCT Filed: Dec. 29, 2018

(86) PCT No.: PCT/CN2018/125744
§ 371 (c)(1),
(2) Date: Dec. 29, 2020

(87) PCT Pub. No.: WO2020/000986
PCT Pub. Date: Jan. 2, 2020

(65) Prior Publication Data

US 2021/0274290 A1 Sep. 2, 2021

(30) Foreign Application Priority Data

Jun. 29, 2018 (CN) ..... 201821049060.2

(51) Int. Cl.
*H04R 9/06* (2006.01)
*H04R 1/02* (2006.01)
(Continued)

(52) U.S. Cl.
CPC ..... *H04R 9/06* (2013.01); *H04R 1/025* (2013.01); *H04R 1/06* (2013.01); *H04R 7/12* (2013.01); *H04R 9/025* (2013.01); *H04R 9/045* (2013.01)

(58) Field of Classification Search
CPC . H04R 9/06; H04R 1/025; H04R 1/06; H04R 7/12; H04R 9/025; H04R 9/045;
(Continued)

(56) References Cited

U.S. PATENT DOCUMENTS 5,594,805 A * 1/1997 Sakamoto ..... H04R 9/02 381/432
9,749,726 B2 * 8/2017 Lee ..... H04R 1/025
(Continued)

FOREIGN PATENT DOCUMENTS

CN 105246006 A 1/2016
CN 205596335 U 9/2016

*Primary Examiner* — Alexander Krzystan
*Assistant Examiner* — Julie X Dang
(74) *Attorney, Agent, or Firm* — Baker Botts, LLP

(57) ABSTRACT

The present disclosure relates to a speaker and a speaker module, and the speaker comprises: a housing and a vibration system housed within the housing, wherein the vibration system comprises a diaphragm and a voice coil, the voice coil is bonded onto a central portion of the diaphragm, and the voice coil has a lead wire; an end surface of the housing connected to a fixed portion of the diaphragm is provided thereon with a conductive portion; a portion of the lead wire located between the fixed portion and the housing is configured to expose the lead wire and form an exposed conductive end, and when the fixed portion is fixedly connected to the housing, the exposed conductive end is crimped onto the conductive portion and is electrically connected to the conductive portion. One technical problem to be solved by the present utility model is how to avoid the occurrence of false welding when the lead wire is connected to the conductive portion of the housing during an assembling process, thereby avoiding the problem of poor contact.

9 Claims, 2 Drawing Sheets

(51) Int. Cl.

| | |
|---|---|
| ***H04R 1/06*** | (2006.01) |
| ***H04R 7/12*** | (2006.01) |
| ***H04R 9/02*** | (2006.01) |
| ***H04R 9/04*** | (2006.01) |

(58) Field of Classification Search
CPC ... H04R 1/00; H04R 31/003; H04R 2209/021
See application file for complete search history.

(56) References Cited

U.S. PATENT DOCUMENTS

| | | | | |
|---|---|---|---|---|
| 2013/0170688 | A1* | 7/2013 | Cohen | H04R 1/30<br>381/351 |
| 2013/0287246 | A1 | 10/2013 | Sasaki et al. | |
| 2016/0142803 | A1* | 5/2016 | Ara | H04R 9/06<br>381/394 |
| 2018/0376248 | A1* | 12/2018 | Yuen | H04R 1/2826 |

* cited by examiner

SPEAKER AND SPEAKER MODULE

CROSS-REFERENCE TO RELATED APPLICATIONS

This application is a National Stage of International Application No. PCT/CN2018/125744, filed on Dec. 29, 2018, which claims priority to Chinese Patent Application No. 201821049060.2, filed on Jun. 29, 2018, both of which are hereby incorporated by reference in their entireties.

TECHNICAL FIELD

The present disclosure belongs to the technical field of electro-acoustic converters. Specifically, the disclosure relates to a speaker and a speaker module.

BACKGROUND

The speaker is an important sound generating component in the electronic product, and is used to convert the sound signal into sound. Currently, the commonly used speaker is a moving coil speaker, in which the vibration system has a voice coil, and lead wires are drawn from the voice coil. When the speaker is working, the voice coil is subjected to electromagnetic force to vibrate, which drives the diaphragm to vibrate. In the prior art, in order to achieve the connection of the lead wire to the outside, mostly, the lead wire is connected to the pad on the housing of the speaker using a hot pressure welding process.

However, when the lead wire and the pad are connected by the hot pressure welding process, the surface of the pad or the wire surface of the lead wire needs to be tinned in advance, and thus the cost of the materials for the assembly is higher. Moreover, during welding, false welding is prone to occur, which can easily lead to poor welding and poor contact between the lead wire and the pad, which affects the acoustic performance of the speaker.

SUMMARY

An object of this disclosure is to provide a way to avoid the problem of poor contact between the lead wire of the voice coil and the conductive portion of the housing.

According to an aspect of the disclosure, a speaker is provided, comprising a housing and a vibration system housed within the housing; wherein the vibration system comprises a diaphragm and a voice coil, the voice coil is bonded onto a central portion of the diaphragm, and the voice coil has a lead wire;

an end surface of the housing connected to a fixed portion of the diaphragm is provided with a conductive portion thereon;

and wherein a portion of the lead wire located between the fixed portion and the housing is configured to expose the lead wire and form an exposed conductive end, and when the fixed portion is fixedly connected to the housing, the exposed conductive end is crimped onto the conductive portion and is electrically connected to the conductive portion.

Optionally, the lead wire, from a wire-out end of the lead wire to the exposed conductive end, has an extension section and a bending section which are connected in sequence; the extension section extends along a corrugated rim of the diaphragm, the bending section extends from between the voice coil and the diaphragm to the conductive portion, and the bending section has the exposed conductive end thereon.

Optionally, the housing is provided with a support platform, the support platform extends from the conductive portion along an extension path of the extension section, and the extension section is partially connected to the support platform.

Optionally, a connection wall is provided around a side of the fixed portion facing the housing, and the fixed portion is connected to the housing through the connection wall.

Optionally, a plurality of connection baffles are provided on the housing, and the connection baffles are connected to a side of the connection wall facing the voice coil.

Optionally, two conductive portions are provided on the end surface of the housing connected to the fixed portion of the diaphragm, and a partition baffle is disposed between the two conductive portions and connected to a side of the connection wall facing the voice coil.

Optionally, a metal member is embedded in the housing, and the conductive portion is a metal surface of the metal member that is electrically connected to the exposed conductive end;

and the exposed conductive end is a metal wire of the lead wire after an outer insulating layer of the lead wire is removed by a laser.

Optionally, the voice coil has a connecting pin, and the connecting pin is connected with the lead wire;

a tensile strength of the lead wire is greater than a tensile strength of a wire material wound into the voice coil, and an electrical conductivity of the wire material wound into the voice coil is greater than an electrical conductivity of the lead wire.

Optionally, the speaker further comprises a magnetic circuit system, the magnetic circuit system being fixedly arranged in the housing;

wherein the magnetic circuit system comprises a magnetic conductive yoke, a magnet and a washer, the magnetic conductive yoke comprises a bottom plate and a side wall, the magnet is arranged on the bottom plate, the washer is arranged on a side of the magnet facing away from the bottom plate, and the voice coil is suspended in a gap formed by the magnet and the side wall of the magnetic conductive yoke;

an end surface of the side wall away from the bottom plate abuts against a part of the lead wire.

The disclosure further provides a speaker module, comprising: a module shell and the speaker as described above; wherein the speaker is arranged in the module shell, the module shell has a sound outlet, and a sound emitted by the speaker is transmitted from the sound outlet.

A technical effect of this disclosure is that after the diaphragm is fixedly connected to the housing through the fixed portion, the exposed conductive end of the lead wire of the voice coil is fixedly connected to the conductive portion of the housing, such that the lead wire and the conductive portion form an electrical connection. Since the hot pressure welding process is not used, the conductive portion and the exposed conductive end of the lead wire do not need to be tinned in advance, which reduces the cost in terms of materials and assembly, can effectively avoid the problem of false welding during welding, avoid poor welding, and ensure the stable connection between the lead wire and the conductive portion, thereby ensuring the stability of the acoustic performance of the speaker.

Other features and advantages of this disclosure will become clear through the following detailed description of exemplary embodiments of this disclosure with reference to the accompanying drawings.

BRIEF DESCRIPTION OF THE DRAWINGS

The drawings constituting a part of the specification describe the embodiments of this disclosure, and together with the specification are used to explain the principle of this disclosure.

DRAWING REFERENCE SIGNS

Figure 1:
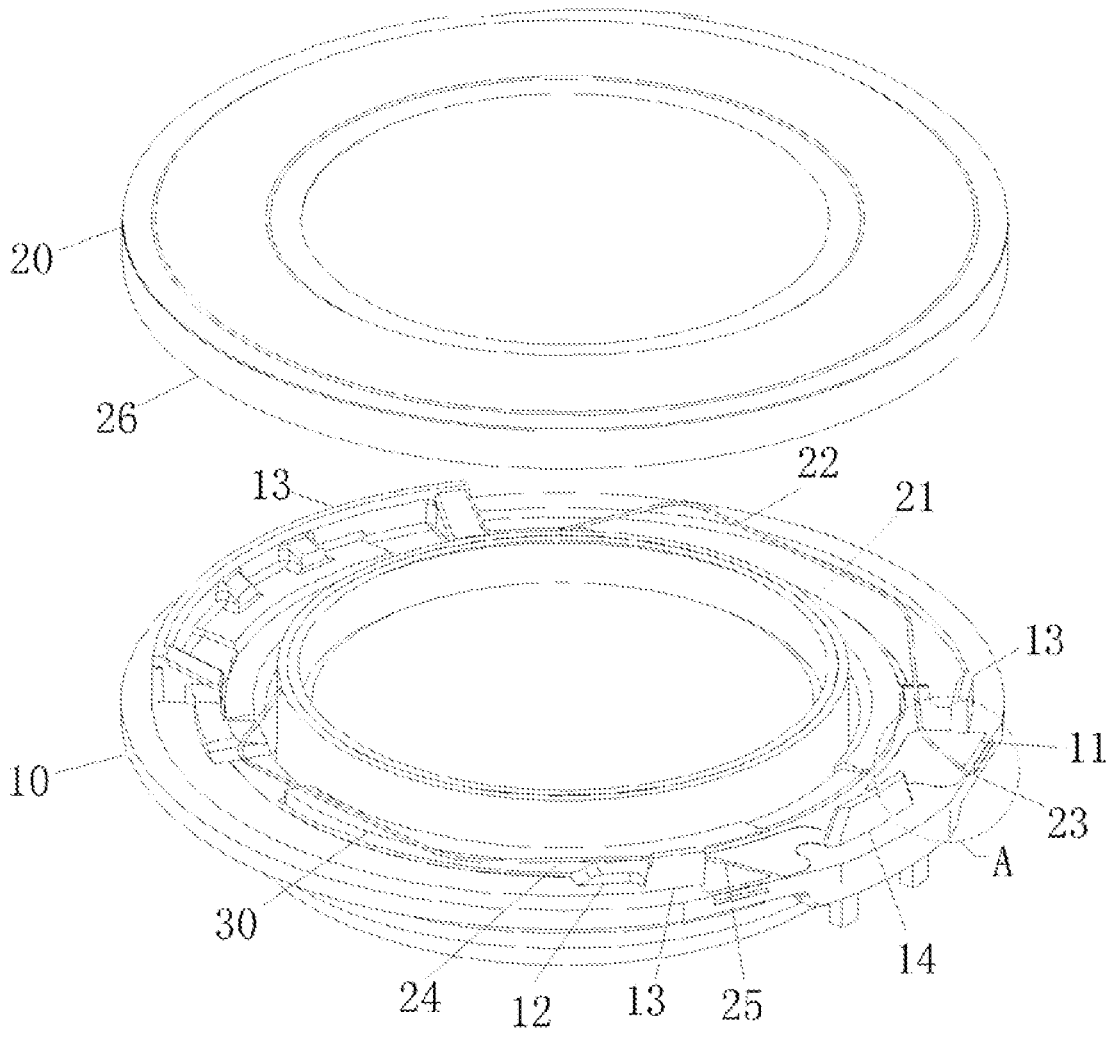
FIG. 1 is an exploded schematic structure diagram of a speaker provided by this disclosure.

10: housing; 11: conductive portion; 12: support platform; 13: connection baffle; 14: partition baffle;

20: diaphragm; 21: voice coil; 22: lead wire; 23: exposed conductive end; 24: extension section; 25: bending section; 26: connection wall;

30: side wall.

DETAILED DESCRIPTION

Various exemplary embodiments of this disclosure will now be described in detail with reference to the accompanying drawings. It should be noted that unless specifically stated otherwise, the relative arrangement, numerical expressions and numerical values of the components and steps set forth in these embodiments do not limit the scope of this disclosure.

The following description of at least one exemplary embodiment is actually only illustrative, and in no way serves as any restriction on this disclosure and its application or use.

Techniques and devices known to those of ordinary skill in the related art may not be discussed in detail, but where appropriate, the techniques and devices should be considered as part of the description.

In all examples shown and discussed herein, any specific values should be interpreted as exemplary only and not as limitations. Therefore, other examples of the exemplary embodiment may have different values.

It should be noted that similar reference numerals and letters indicate similar items in the following drawings, and therefore, once an item is defined in one drawing, it does not need to be discussed further in subsequent drawings.

Figure 2:
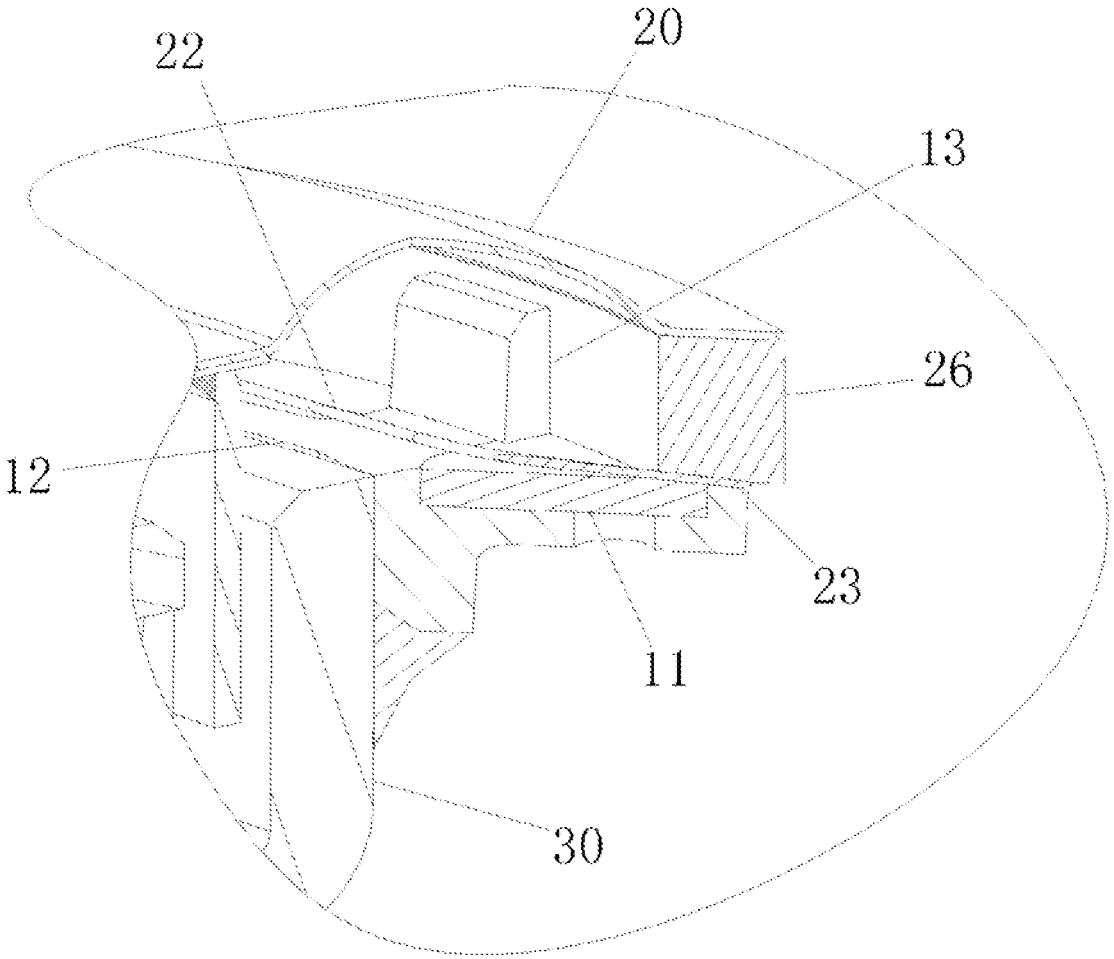
FIG. 2 is a side sectional view at A in FIG. 1.

FIG. 1 is an exploded schematic structure diagram of a speaker provided by this disclosure, and FIG. 2 is a side sectional view at A in FIG. 1, referring to FIGS. 1 and 2.

According to an aspect of the disclosure, a speaker is provided, comprising a housing 10 and a vibration system housed within the housing 10.

The vibration system comprises a diaphragm 20 and a voice coil 21, the voice coil 21 is bonded onto a central portion of the diaphragm 20, and the voice coil 21 has a lead wire 22.

An end surface of the housing 10 connected to a fixed portion of the diaphragm 20 is provided with a conductive portion 11 thereon.

A portion of the lead wire 22 located between the fixed portion and the housing 10 is configured to expose the lead wire and form an exposed conductive end 23, and when the fixed portion is fixedly connected to the housing 10, the exposed conductive end 23 is crimped onto the conductive portion 11 and is electrically connected to the conductive portion 11.

The technical effect of the embodiment of this disclosure is that after the diaphragm 20 is fixedly connected to the housing 10 through the fixed portion, the exposed conductive end 23 of the lead wire 22 of the voice coil 21 is fixedly connected to the conductive portion 11 of the housing 10, such that the lead wire 22 and the conductive portion 11 form an electrical connection. Since the hot pressure welding process is not used, the conductive portion 11 and the exposed conductive end 23 of the lead wire 22 do not need to be tinned in advance, which reduces the cost in terms of materials and assembly, can effectively avoid the problem of false welding during welding, avoid poor welding, and ensure the stable connection between the lead wire 22 and the conductive portion 11, thereby ensuring the stability of the acoustic performance of the speaker.

The speaker provided by the embodiments of this disclosure will be described in further detail below.

In an embodiment of this disclosure, when the diaphragm 20 is connected to the housing 10 through the fixed portion, the connection may be achieved by the conventional assembly processes such as ultrasonic process, hot melt process and glue process. In an achievable way, the voice coil 21 has two lead wires 22, the housing 10 is provided with two conductive portions 11, and the two lead wires 22 are respectively connected to different conductive portions 11 through the exposed conductive ends 23 to respectively achieve the electrical connection.

Continue to refer to FIG. 1, optionally, the lead wire 22, from a wire-out end of the lead wire 22 to the exposed conductive end 23, has an extension section 24 and a bending section 25 which are connected in sequence. The extension section 24 extends along the corrugated rim of the diaphragm 20 such that the lead wire 22 may be better match the vibration of the diaphragm 20 to vibrate together, thus reducing the interference of the lead wire 22 to the vibration of the diaphragm 20 and the voice coil 21. The bending section 25 extends from between the voice coil 21 and the diaphragm 20 to the conductive portion 11, and the bending section 25 has an exposed conductive end 23 thereon. The exposed conductive end 23 is connected to the conductive portion 11 of the housing 10, which is used to introduce sound signals.

In order to reduce the pulling force on the exposed conductive end 23 during vibration, optionally, the housing 10 is provided with a support platform 12, the support platform 12 extends from the conductive portion 11 along an extension path of the extension section 24, and the extension section 24 is partially connected to the support platform 12. When the lead wire 22 is vibrating towards a direction close to the support platform 12, the extension section 24 of the lead wire 22 is blocked by the support platform 12, the support platform 12 provides a support force for the extension section 24 of the lead wire 22, and the support platform 12 changes the position of the vibration fulcrum, such that the position of the vibration fulcrum is far away from the exposed conductive end 23, thereby reducing the pulling force of the exposed conductive end 23 and avoiding the lead wire 22 and the conductive portion 11 from being separated.

Continue to refer to FIGS. 1 and 2, optionally, a connection wall 26 is provided around a side of the fixed portion facing the housing 10, and the fixed portion is connected to the housing 10 through the connection wall 26. The connection wall 26 may increase the thickness of the fixed portion of the diaphragm 20, so that there are more ways to connect the fixed portion and the housing 10. The connection wall 26 and the housing 10 may be connected by means of an ultrasonic process, a hot melt process, a glue process, etc., which may enhance the connection strength between the fixed portion and the housing 10.

To further enhance the connection strength between the connection wall 26 and the housing 10, optionally, a plurality of connection baffles 13 are provided on the housing 10, and the connection baffles 13 are connected to a side of the connection wall 26 facing the voice coil 21. The connection position of the connection wall 26 can be located by the connection baffle 13 to ensure the stability of the connection position of the diaphragm 20.

In this disclosure, optionally, two conductive portions 11 are provided on the end surface of the housing 10 connected to the fixed portion of the diaphragm 20, and a partition baffle 14 is disposed between the two conductive portions 11 and the partition baffle 14 is connected to a side of the connection wall 26 facing the voice coil 21. The partition baffle 14 can prevent the lead wire 22 of the voice coil 21 from being connected to the same conductive portion 11 during the assembly process. In addition, the connection strength between the connection wall 26 and the housing 10 may be further enhanced by the partition baffle 14.

In the embodiment of this disclosure, optionally, a metal member is embedded in the housing 10, and one possible implementation of the conductive portion 11 is a metal surface of the metal member that is electrically connected to the exposed conductive end 23, wherein the metal surface does not need to be tinned in advance. One possible implementation of the exposed conductive end 23 is a metal wire of the lead wire 22 after removing the outer insulating layer. For example, the lead wire 22 may be a kind of enameled wire. The outer insulating layer of the enameled wire is removed by a laser, and the part of the removed insulating layer exposes the inner metal wire. The metal wire is clamped between the fixed portion of the diaphragm 20 and the conductive portion 11 of the housing 10, and the metal wire is fixed on the conductive portion 11 of the housing 10 through the fixed portion, such that the lead wire 22 and the conductive portion 11 form an electrical connection through the metal wire.

In the embodiment of this disclosure, the lead wire 22 and the voice coil 21 may be integrally arranged, that is, the lead wire 22 and the wire material wound into the voice coil 21 are integral. The lead wire 22 and the voice coil 21 may also be arranged separately, that is, the lead wire 22 and the wire material wound into the voice coil 21 are different wire bodies.

When the lead wire 22 and the voice coil 21 are arranged separately, optionally, the voice coil 21 has a connecting pin, and the connecting pin is connected with the lead wire 22. The connecting pin is used for transmitting the sound signal introduced from the lead wire 22 to the voice coil 21. The connecting pin extends from the voice coil 21, and the connecting pin may be connected with the lead wire 22 by welding or bonding to form an electrical connection. The connecting pin of this disclosure and the bending section 25 do not directly form a fixed connection, thereby reducing the vibration force received by the lead wire 22 and reducing the risk of the lead wire 22 being broken.

In an achievable way, the voice coil 21 has two lead wires 22, and correspondingly, the voice coil 21 has two connecting pins. Two lead wires 22 are respectively welded to two connecting pins, wherein one of the lead wires 22 and one of the connecting pins form an electrical connection, and the other lead wire 11 and the other connecting pin form an electrical connection. As such, the two lead wires 22 are respectively electrically connected to two positions of the voice coil 21 through different connecting pins, forming a complete loop for the conduction of the sound signal on the voice coil 21.

When the lead wire 22 and the voice coil 21 are arranged separately, further, wire materials with different properties and sizes may be used to make the lead wire 22 and the voice coil 21. In turn, the lead wire 22 and the voice coil 21 highlight different performance characteristics. For example, a tensile strength of the lead wire 22 is greater than a tensile strength of a wire material wound into the voice coil 21, and an electrical conductivity of the wire material wound into the voice coil 21 is greater than an electrical conductivity of the lead wire 22. The lead wire 22 is made from a material with higher tensile strength, and the diameter of the lead wire 22 may be relatively large. The risk of wire breakage of the lead wire 22 during the vibration of the diaphragm 20 is reduced. However, the wire material used to be wound into the voice coil 21 is made from a material with relatively large electrical conductivity, and the diameter of the wire material of the voice coil 21 may be relatively small. The increase in the electrical conductivity of the voice coil 21 helps to improve the response sensitivity of the vibrating component to the sound signal and improve its acoustic performance.

Optionally, the speaker further comprises a magnetic circuit system which is fixedly arranged in the housing 10. Refer to FIG. 1, the other components outside the side wall 30 of the magnetic circuit system in FIG. 1 are not shown. The magnetic circuit system comprises a magnetic conductive yoke, a magnet and a washer, wherein the magnetic conductive yoke comprises a bottom plate and a side wall 30, the magnet is arranged on the bottom plate, the washer is arranged on a side of the magnet facing away from the bottom plate, and the voice coil 21 is suspended in a gap formed by the magnet and the side wall 30 of the magnetic conductive yoke.

An end surface of the side wall 30 away from the bottom plate abuts against a part of the lead wire 22. The side wall 30 provides support for the lead wire 22. The function of the side wall 30 to the lead wire is similar to the function of the support platform 12. For example, when the lead wire 22 is vibrating towards a direction close to the side wall 30, the extension section 24 of the lead wire 22 is blocked by the side wall 30, the side wall 30 provides a support force for the extension section 24 of the lead wire 22, and the side wall 30 changes the position of the vibration fulcrum, such that the position of the vibration fulcrum is far away from the exposed conductive end 23, thereby reducing the pulling force of the exposed conductive end 23 and avoiding the lead wire 22 and the conductive portion 11 from being separated. In addition, through the supporting effect of the side wall 30 for the lead wire 22, the lead wire 22 has relatively little interference to the vibration of the voice coil 21 and the diaphragm 20, and when the diaphragm 20 is vibrating, the interference of the lead wire 22 to the vibration of the diaphragm 20 and the voice coil 21 may be reduced.

Further, the disclosure further provides a speaker module, comprising: a module shell and the speaker as described above; wherein the speaker is arranged in the module shell, the module shell has a sound outlet, and a sound emitted by the speaker is transmitted from the sound outlet.

Different from the speaker, the speaker module may be composed of a module shell being with a front sound cavity, a rear sound cavity and other structures, and the speaker may be arranged in the module shell. In the speaker module, the coordination mode of the vibration system and the magnetic circuit system and the coordination mode of the vibration system and the speaker can be referred to each other, which will not be repeated here.

Although some specific embodiments of this disclosure have been described in detail through examples, those skilled in the art should understand that the above examples are only for illustration and not for limiting the scope of this disclosure. Those skilled in the art should understand that the above embodiments can be modified without departing from the scope and spirit of this disclosure. The scope of this disclosure is defined by the appended claims.

The invention claimed is:

1. A speaker, comprising a housing and a vibration system housed within the housing; wherein the vibration system comprises a diaphragm and a voice coil bonded onto a central portion of the diaphragm and including a lead wire;

wherein an end surface of the housing is connected to a fixed portion of the diaphragm and provided with a conductive portion thereon;

wherein a portion of the lead wire located between the fixed portion and the housing is configured to expose the lead wire and form an exposed conductive end, such that when the fixed portion is fixedly connected to the housing, the exposed conductive end is crimped onto the conductive portion and is electrically connected to the conductive portion; and wherein the lead wire, from a wire-out end of the lead wire to the exposed conductive end, has an extension section and a bending section which are connected in sequence; the extension section extends along a corrugated rim of the diaphragm, the bending section extends from between the voice coil and the diaphragm to the conductive portion, and the bending section has the exposed conductive end thereon.

2. The speaker according to claim 1 wherein the housing is provided with a support platform, the support platform extends from the conductive portion along an extension path of the extension section, and the extension section is partially connected to the support platform.

3. The speaker according to claim 1, wherein a connection wall is provided around a side of the fixed portion facing the housing, and the fixed portion is connected to the housing through the connection wall.

4. The speaker according to claim 3, wherein a plurality of connection baffles are provided on the housing, and the connection baffles are connected to a side of the connection wall facing the voice coil.

5. The speaker according to claim 3, wherein two conductive portions are provided on the end surface of the housing connected to the fixed portion of the diaphragm, and a partition baffle is disposed between the two conductive portions and connected to a side of the connection wall facing the voice coil.

6. The speaker according to claim 1, wherein a metal member is embedded in the housing, and the conductive portion is a metal surface of the metal member that is electrically connected to the exposed conductive end;

and the exposed conductive end comprises an exposed metal wire of the lead wire without insulation.

7. The speaker according to claim 1, wherein the voice coil has a connecting pin, and the connecting pin is connected with the lead wire;

a tensile strength of the lead wire is greater than a tensile strength of a wire material wound into the voice coil, and an electrical conductivity of the wire material wound into the voice coil is greater than an electrical conductivity of the lead wire.

8. The speaker according to claim 1, further comprising a magnetic circuit system, the magnetic circuit system being fixedly arranged in the housing;

wherein the magnetic circuit system comprises a magnetic conductive yoke, a magnet and a washer, the magnetic conductive yoke comprises a bottom plate and a side wall, the magnet is arranged on the bottom plate, the washer is arranged on a side of the magnet facing away from the bottom plate, and the voice coil is suspended in a gap formed by the magnet and the side wall of the magnetic conductive yoke;

an end surface of the side wall away from the bottom plate abuts against a part of the lead wire.

9. A speaker module, comprising: a module shell and the speaker according to claim 1; wherein the speaker is arranged in the module shell, the module shell has a sound outlet adapted to transmit a sound emitted by the speaker.

* * * * *